United States Patent [19]

Rowley et al.

[11] Patent Number: 4,779,427

[45] Date of Patent: Oct. 25, 1988

[54] HEAT ACTUATED HEAT PUMP

[75] Inventors: C. Allen Rowley, Mesa; Hector M. Gutierrez, Phoenix, both of Ariz.

[73] Assignee: E. Squared Incorporated, Mesa, Ariz.

[21] Appl. No.: 147,322

[22] Filed: Jan. 22, 1988

[51] Int. Cl.[4] ..... F25B 1/00

[52] U.S. Cl. ..... 62/467; 62/116

[58] Field of Search ..... 62/116, 467

[56] References Cited

U.S. PATENT DOCUMENTS

| | | | |
|---|---|---|---|
| 3,823,573 | 7/1974 | Cassady | 62/116 |
| 3,861,166 | 1/1975 | Goldsberry | 62/116 |
| 4,418,547 | 12/1983 | Clark, Jr. | 62/116 |
| 4,450,690 | 5/1984 | Clark, Jr. | 62/116 |
| 4,537,036 | 8/1985 | Clark, III | 62/467 |
| 4,537,037 | 8/1985 | Clark, Jr. | 62/116 |
| 4,617,801 | 10/1986 | Clark, Jr. | 62/116 |
| 4,693,090 | 9/1987 | Blackman | 62/467 |

*Primary Examiner*—Ronald C. Capossela

*Attorney, Agent, or Firm*—Warren F. B. Lindsley

[57] ABSTRACT

A thermally powered heat transfer system employing a boiler for producing a refrigerant in vaporized form at relatively high pressure, the output of the boiler being connected to a pump, aspirator or compressor which may comprise a single cylinder, double piston structure functioning as a power source for moving the refrigerant and a pumping source for creating a low pressure for drawing refrigerant vapor form from an evaporator and into the condenser where the refrigerant vapor gives up its heat. The condenser is coupled in circuit with receiver means which holds liquid refrigerant and delivers same to the boiler and evaporator under control of suitable valving means.

14 Claims, 3 Drawing Sheets

HEAT ACTUATED HEAT PUMP

BACKGROUND OF THE INVENTION

As recently as fifty years ago, extensive areas of the United States including the lower elevations of Arizona, eastern California and southern Texas were shunned by industry and others seeking new locations for settlement because of the very high prevailing temperatures during the summer months.

Then, with the advent of the evaporative cooler and more recently with the development of modern refrigeration systems and heat pumps, a remarkable change was brought about. These new conveniences completely transformed the environment in such areas. It was soon recognized that with refrigerated living quarters, offices, factories, shopping centers and automobiles, the hot summer months in these climates were no match in terms of physical discomfort for the cold and cloudy winters in other parts of the country. People and industry soon began to be drawn to these areas in droves for the enjoyment of what is now recognized as one of the most desirable climates in the world in terms of year-round comfort.

Rising energy costs and concerns about energy shortages now threaten to slow the pace of this trend, but with such concerns a new technological thrust has developed. The goal of the new technology goes beyond the development of improved energy efficiencies in refrigeration systems or heat pumps; it centers instead upon the development of heat pump systems that are operable from energy sources such as solar energy that are not depleted by use.

The present invention which falls within the scope of this new technology, uses the heat energy itself as a power source for moving heat from one point to another, relying for operation upon a temperature difference between the cooled and the uncooled environment.

DESCRIPTION OF THE PRIOR ART

U.S. Pat. No. 4,418,547 discloses a thermally powered heat transfer system comprising two closed heat transfer loops. The two loops share a single compressor which is alternately powered by the refrigerants of the two loops. This system is powered by two heat sources having different temperatures of which the lower temperature heat source may be the heat within the structure to be cooled. An evaporator of the first loop located within the structure to be cooled is charged with a low boiling point refrigerant while an evaporator of the second loop is heated by a higher temperature heat source and is charged with a higher boiling point refrigerant. The heat sinks of the two loops are at temperatures between those of the two heat sources. Controls are activated at the completion of each compressor stroke or cycle to alternately open and close valves which regulate vapor and liquid flows, causing the compressor to act with compressive force upon one or the other refrigerant vapor during each cycle of operation of the system to effect useful heat transfer.

The compressor in U.S. Pat. No. 4,418,547 utilizes two cylinders mounted side-by-side at the same level. A fluid conduit connects the base of one cylinder to the base of the other, and the lower portions of both cylinders are filled with a fluid such as water or mercury, the fluid filling the conduit also. The fluid serves as a piston that is common to both cylinders so that as pressure forces the fluid downward in one cylinder, the fluid is driven through the conduit into the other cylinder, raising the fluid level in the second cylinder.

U.S. Pat. No. 4,450,690 discloses a second thermally powered heat transfer system similar to the one just described, but incorporating gravitational assistance in the compressor. In this case, one of the cylinders is mounted above the other. The fluid conduit now joins the bottom of the upper cylinder with the top of the lower cylinder. The fluid is confined within the lower portion of the upper cylinder and within the upper portion of the lower cylinder by flexible membranes at the fluid boundaries in both cylinders. The liquid again serves as the commonly coupled piston with the weight of the fluid in the two cylinders and in the fluid conduit assisting in the downward stroke. The gravitational assistance is claimed to result in the achievement of far lower temperatures in the structure or products being refrigerated than can be realized in the earlier system of U.S. Pat. No. 4,418,547.

U.S. Pat. No. 4,537,037 discloses a thermally powered heat transfer system utilizing sequential displacement. In this heat transfer system, thermal energy is displaced from the highest temperature heat source through two or more high temperature heat transfer loops to a heat sink. The system includes two or more two chamber compressors with the high temperature chamber of each compressor being included in a high temperature heat transfer loop, there being a high temperature heat transfer loop for each compressor. The low temperature chamber of each compressor is included in one or more low temperature heat transfer loops. The source of heat for the evaporator heat exchanger of each high temperature heat transfer loop except one being heat from the condenser heat exchanger of another high temperature loop. The heat exchangers for the low temperature heat transfer loops being interchangeable depending on the mode of operation at any given time.

U.S. Pat. No. 4,617,801 discloses a thermally powered engine which obtains energy from a closed heat transfer loop. The engine has two power cylinders. A piston is reciprocally mounted within each cylinder and divides the interior space of each cylinder into two portions. A piston rod is affixed to each piston and extends through the upper closed end of each cylinder. A flexible diaphragm is mounted in the lower portion of each cylinder and with the lower closed end of the cylinder forms a power chamber. A fluid fills the upper portion of both cylinders. A passageway between the cylinders permits the fluid to act as a free piston, causing the piston of the cylinder in its exhaust stroke to force refrigerant from its power chamber to the condenser of the heat transfer loop. Refrigerant from the evaporator of the transfer loop flowing into a power chamber forces the piston upward during the piston's power stroke. Valves regulate the flow of refrigerant into and out of the power chambers of each of the power cylinders. Flow of refrigerant is controlled so that motion of the pistons of the two power cylinders is 180° out of phase. Several pairs of power cylinders can be connected in series with the refrigerant flowing through the pairs serially prior to reaching the condenser. Isothermal sequential displacement of the refrigerant through the power chambers of a series of pairs of power cylinders increases the thermal efficiency of the engine.

While the heat transfer systems provided in the prior art as just described have significantly advanced the state of the art in the desired direction, a simpler approach is still needed. For improved cost effectiveness, the compressor, in particular, needs to be simplified, preferably through a reduction in the number of cylinders and pistons involved. The fluid piston is also troublesome because of the tendancy of the fluid to migrate to other parts of the system.

The present invention avoids the use of the fluid piston and relies upon a single pair of directly coupled pistons for the power and pumping operations.

SUMMARY OF THE INVENTION

In accordance with the invention claimed, an improved heat activated heat pump is provided for primary utilization as a refrigeration system. The heat pump of the invention employs two cylinders, each with one piston and each with two chambers, one above and one below the piston. The two pistons are coupled together by a common shaft. One piston is powered and drives the other which is driven and serves in a pumping mode to move refrigerant in the heat transfer loop. The power driver piston is reciprocally driven by high pressure vapor from a boiler or evaporator alternately introduced into the upper or the lower chambers above and below the piston.

It is, therefore, an object of the present invention to provide an improved heat actuated heat pump.

Another object of this invention is to provide a heat pump that can be powered by heat energy drawn directly from the surrounding environment.

A further object of this invention is to provide such a heat pump in a simplified form, utilizing a reduced number of elements as compared with prior art heat actuated heat pumps.

A still further object of this invention is to provide a heat actuated heat pump that can use a single refrigerant in both the power and work loops.

A still further object of this invention is to provide such a heat pump in a form that does not utilize any fluids other than refrigerants, so that the problems typically arising due to the presence of such other fluids may be avoided.

A still further object of this invention is to provide in such a heat pump a means other than a refrigeration pump for returning refrigerant to the boiler or evaporator against high pressure.

Further objects and advantages of the invention will be pointed out with particularity in the claims annexed to and forming a part of this specification.

BRIEF DESCRIPTION OF THE DRAWINGS

The present invention may be more readily described with reference to the accompanying drawings, in which.

DESCRIPTION OF THE PREFERRED EMBODIMENT

Figure 1:
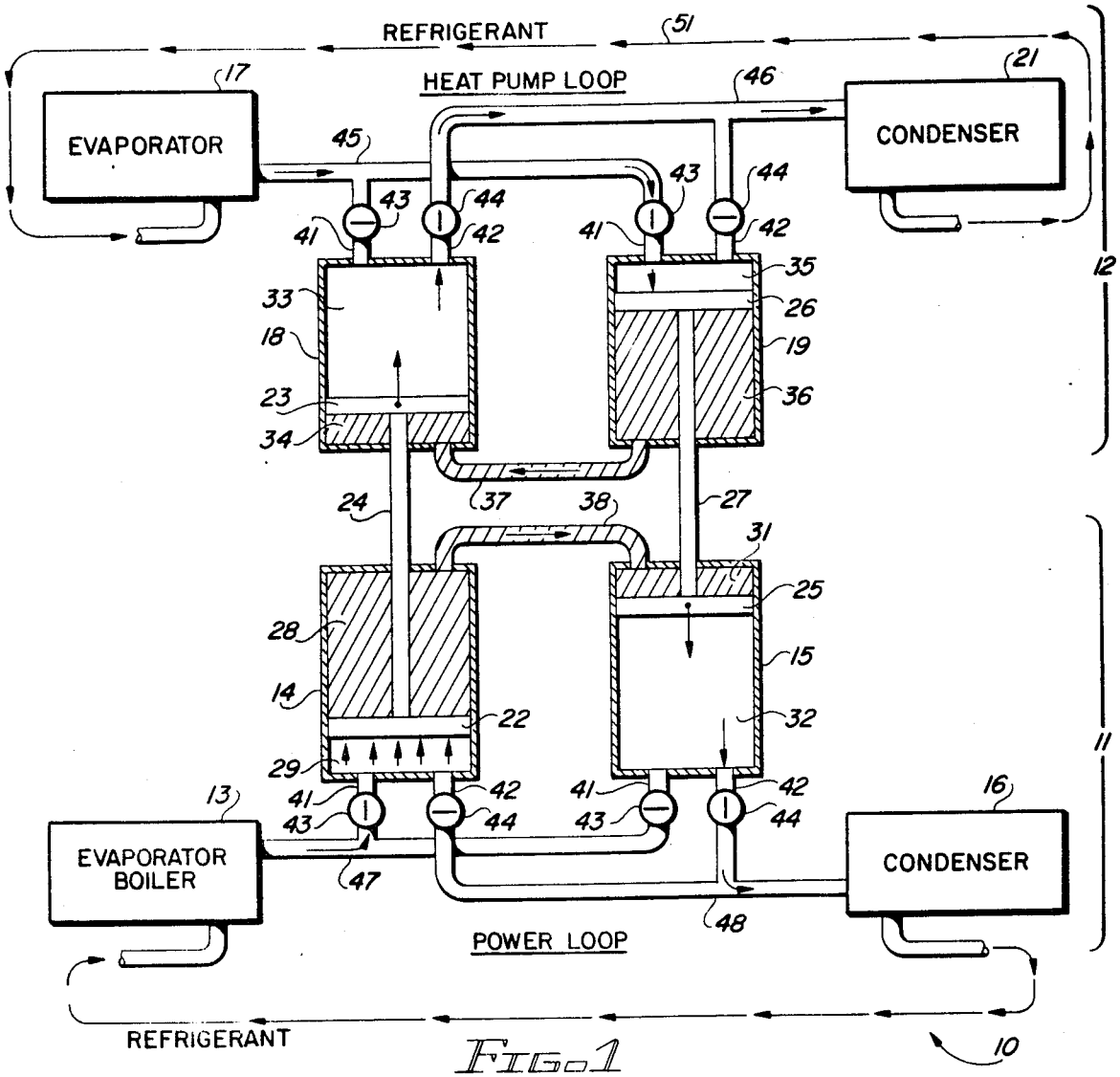
FIG. 1 (PRIOR ART)
FIG. 1 is a functional diagram illustrating the construction and operation of a prior art heat actuated heat pump.

Referring more particularly to the accompanying drawings by characters of reference, FIG. 1 illustrates in simplified form the operating principles embodied in the prior art heat pumps described in U.S. Pat. Nos. 4,418,547; 4,450,690; 4,537,037 and 4,617,801.

The prior art heat actuated heat pump 10 of FIG. 1 comprises a power loop 11 and a heat pump or refrigeration loop 12. Power loop 11 comprises an evaporator or boiler 13, cylinders 14 and 15 and a condenser 16. Heat pump loop 12 comprises an evaporator 17, cylinders 18 and 19 and a condenser 21.

Each of the four cylinders 14, 15, 18 and 19 is equipped with a single piston.

A piston 22 operating within cylinder 14 is coupled to a piston 23 operating within cylinder 18 by a common shaft 24, and a piston 25 operating within cylinder 15 is coupled to a piston 26 operating within cylinder 19 by a common shaft 27.

In each case, the piston divides the cylinder into two chambers, an upper chamber located above the piston, and a lower chamber located below the piston. Thus, cylinder 14 has an upper chamber 28 and a lower chamber 29, cylinder 15 has an upper chamber 31 and a lower chamber 32, cylinder 18 has an upper chamber 33 and a lower chamber 34, and cylinder 19 has an upper chamber 35 and a lower chamber 36. The lower chambers 34 and 36 of cylinders 18 and 19, respectively, are joined by a conduit 37, and the upper chambers 28 and 31 of cylinders 14 and 15, respectively, are joined by a conduit 38. Chambers 28, 31, 34 add 36 and conduits 37 and 38 are filled with a liquid such as glycol.

Each of the four chambers 29, 32, 33 and 35 is provided with an inlet port 41 and an outlet port 42. Associated with each inlet port 41 is an inlet valve 43; an outlet valve 44 is associated with each outlet port 42. The valves 43 and 44 may be opened or closed to control the flow of refrigerant through the associated ports.

The evaporators 13 and 17 and the condensers 16 and 21 are connected to the cylinders of their respective loops via the valves 43 and 44. Thus, evaporator 17 is connected to chambers 33 and 35 via a conduit 45 and via the inlet valves 43. Condenser 21 is connected to chambers 33 and 35 via a conduit 46 and via outlet valves 44. Evaporator 13 is connected to chambers 29 and 32 via a conduit 47 and via inlet valves 43, and condenser 16 is connected to chambers 29 and 32 via a conduit 48 and via outlet valves 44.

Operation of the prior art heat pump 10 proceeds as follows:

During a first half cycle, the valves 43 and 44 are in the positions shown in FIG. 1. The inlet valves 43 of chambers 29 and 35 are open, while those of chambers 32 and 33 are closed. Outlet valves 44 of chambers 32 and 33 are open, and those of chambers 29 and 35 are closed.

Vaporized refrigerant from evaporator 13 enters chamber 29 via its open inlet valve 43 under high pressure. The pressure inside chamber 29 drives piston 22 upward. Piston 23, by virtue of its direct coupling to piston 22 through common shaft 24 is also moved upward with piston 22. As piston 22 moves upward, liquid contained in chamber 28 is forced to flow through conduit 38 into upper chamber 31 of cylinder 15, driving piston 25 downward. Piston 26 moves downward with piston 25 causing liquid to flow from chamber 36 through conduit 37 into chamber 34.

The force exerted upon piston 22 by the pressurized vapor within chamber 29 is thus seen to be coupled to the other three pistons with pistons 22 and 23 moving upward and pistons 25 and 26 moving downward. The upward motion of piston 23 expels refrigerant vapor from chamber 33 through its outlet port 44, the expelled vapor being carried via conduit 46 to condenser 21, while the downward motion of piston 26 draws refrigerant vapor into chamber 35 via its inlet valve 43 and conduit 45 from evaporator 17. At the same time, the downward motion of piston 25 expels vapor from chamber 32 via its outlet valve 44 into conduit 48 and condenser 16.

At the end of the upward stroke of piston 22, the first half cycle of operation terminates and all of the inlet and outlet valves change state. Inlet valves 43 of chambers 32 and 33 are now open, those of chambers 29 and 35 are now closed. Outlet valves 44 of chambers 29 and 35 are now open and those of chambers 32 and 33 are closed. High pressure vapor from evaporator 13 flows through conduit 47 into chamber 32 driving pistons 25 and 26 upward. Liquid forced from chamber 31 through conduit 38 into chamber 28 drives piston 22 and hence also piston 23 downward with liquid flow also occurring from chamber 34 through conduit 37 into chamber 36. The downward motion of piston 23 causes refrigerant to be drawn into chamber 33 via its inlet valve 43 as the upward motion of piston 26 expells refrigerant from chamber 35 via its outlet valve 44 into conduit 46 and condenser 21. At the same time, the downward motion of piston 22 expells vapor from chamber 29 via its outlet valve 44 into conduit 48 and condenser 16.

Upon the completion of the upward stroke of piston 25, the second half cycle terminates and the inlet and outlet valves 43 and 44 again change state. The first half cycle is then repeated.

It has thus been shown that the alternate admission of high pressure vapor from evaporator 13 into chambers 29 and 32 produces a reciprocating power drive upon the four pistons. Driven by this reciprocating action, pistons 23 and 26 pump refrigerant from evaporator 17 to condenser 21 and back to evaporator 17 through the return path represented by the arrows 51. Evaporator 17 operates at low pressure, absorbing heat as the refrigerant vaporizes. The pumping action of pistons 23 and 26 raises the refrigerant pressure to promote condensation in condenser 21. The heat of condensation is expelled from the refrigerant at condenser 21 prior to the return of the refrigerant to evaporator 17.

In power loop 11, pistons 22 and 25 perform the same kind of pumping action in moving the refrigerant from evaporator 13 to condenser 16, except as shown earlier, the pumping action is in this case driven by the high pressure vapor from evaporator 13. Typically, evaporator 13 is exposed to a heat source such as the sun or just to the high outdoor temperature in a residential cooling application. Prior art U.S. Pat. No. 4,418,547 teaches that the refrigerants used in the two loops, 11 and 12, should have different characteristics for proper operation of the system.

While the prior art heat actuated heat pump 10 is thus shown to satisfy the general requirement of not requiring an energy source other than solar or heat energy, the degree of complexity is undesirably high. Four cylinders and four pistons are required for the power and heat pump loops. Furthermore, two different refrigerants and a pumping liquid such as glycol, are also required. The glycol is proven to be especially troublesome, because of its tendancy to pass through seals and around pistons to contaminate refrigerants and equipment.

Figure 2:
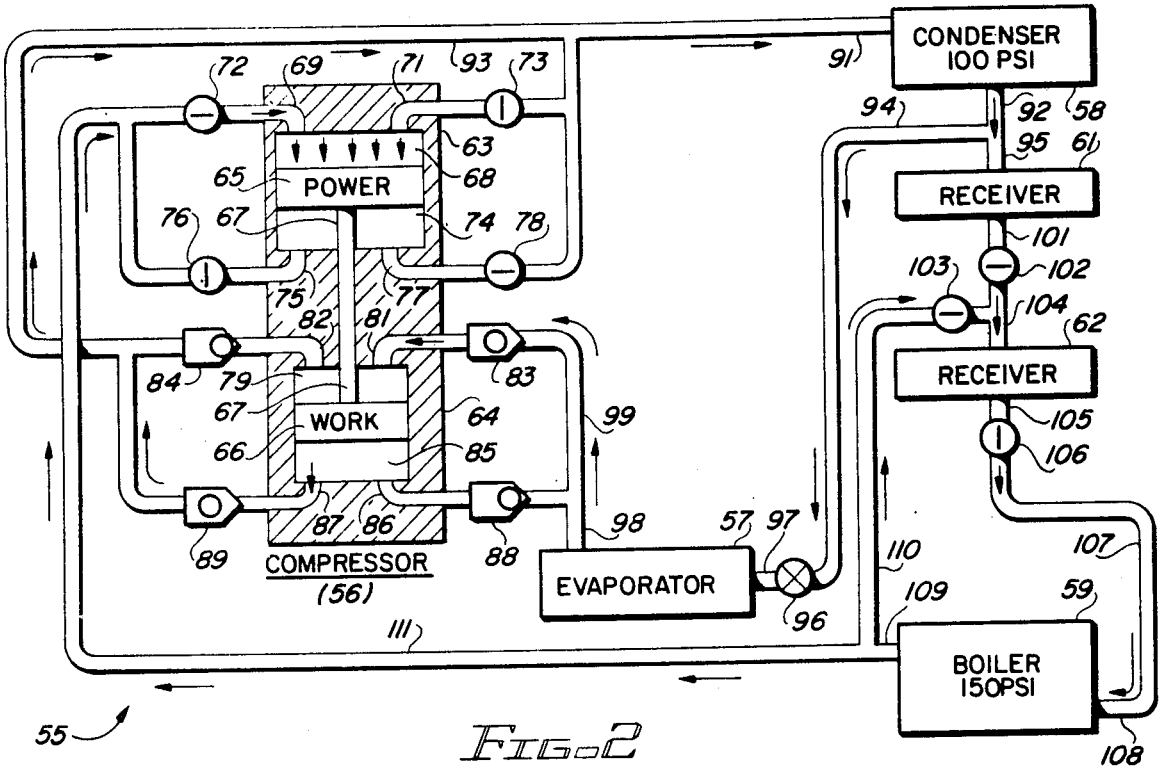
FIG. 2 is a functional diagram illustrating the construction and operation of a first embodiment of the heat actuated heat pump of the present invention.

The heat actuated heat pump 55 of FIG. 2 represents a first embodiment of the present invention. Heat pump 55 comprises a compressor 56, an evaporator 57, a condenser 58, a boiler 59 and first and second receivers 61 and 62.

Compressor 56 is essentially a pump or aspirator driven by pressure from boiler 59 with the aspirator serving to draw vapor from evaporator 57. Other forms of aspirators, such as venturi types, can readily be substituted for the piston type compressor 56 shown in FIGS. 2 and 3.

Compressor 56 comprises a power cylinder 63 and a work cylinder 64 which may comprise one geometrical configuration. Power cylinder 63 is preferably larger in internal diameter than the internal diameter of work cylinder 64. In each of the two cylinders a piston divides the cylinder into two chambers, here designated an upper chamber and a lower chamber. The two pistons, piston 65 in the power cylinder 63 and piston 66 in the work cylinder 64, are directly coupled together by a common shaft 67.

Power cylinder 63 has an upper chamber 68 with an inlet port 69 and an exhaust port 71. Flow through port 69 is controlled by a serially connected valve 72, and flow through port 71 is controlled by a serially connected valve 73. The lower chamber 74 of cylinder 63 has an inlet port 75 controlled by a valve 76 and an outlet port 77 controlled by a valve 78. Valves 72, 73, 76 and 78 are responsive to control signals during heat pump operation.

Work cylinder 64 has an upper chamber 79 with an inlet port 81 and an outlet port 82. Port 81 is controlled by a valve 83 and port 82 is controlled by a valve 84. The lower chamber 85 of cylinder 64 has an inlet port 86 and an outlet port 87. Ports 86 and 87 are controlled by valves 88 and 89, respectively. Valves 83, 84, 88 and 89 are pressure-sensitive valves which permit flow in one direction and block flow in the opposite direction. Valves of this type are commonly known as check valves or one-way valves. Thus, valves 83 and 88 will permit the flow of refrigerant into chambers 79 and 85 via inlet ports 81 and 86, respectively, but block flow in the reverse direction. Similarly, valves 84 and 89 permit flow from chambers 79 and 85, respectively, but block return flow into these chambers.

Condenser 58 has an inlet port 91 and an outlet port 92. Inlet port 91 is connected by a refrigerant conduit 93 to valves 73 and 78 of power cylinder 63, and to valves 84 and 89 of work cylinder 64. Outlet port 92 is connected by a refrigerant conduit 94 to an inlet port 95 of receiver 61, and through an expansion valve 96 to an inlet port 97 of evaporator 57. Evaporator 57 has its outlet port 98 connected via a refrigerant conduit 99 to valves 83 and 88 of work cylinder 64.

Receiver 61 has its outlet port 101 connected through a valve 102 to the downstream side of another valve 103, and to the inlet port 104 of receiver 62. Receiver 62 has its outlet port 105 connected through a valve 106 and a refrigerant conduit 107 to an inlet port 108 of boiler 59. Boiler 59 has its outlet port 109 connected by a refrigerant conduit 110 to the upstream side of valve 103, and by another refrigerant conduit 111 to valves 72 and 76.

The heat actuated heat pump 55 as just described, comprises a power loop and a work or heat pump loop. The power loop includes power cylinder 63, condenser 58, receivers 61 and 62 and boiler 59; the work loop includes work cylinder 64, condenser 58 and evaporator 57. Operation of heat pump 55 proceeds as follows:

In a first half cycle of operation, valves 72 and 78 are open and valves 73 and 76 are closed, as shown in FIG. 2. High pressure refrigerant vapor from boiler 59 flows through line 111 and through valve 72 and port 69 into upper chamber 68 of power cylinder 63. Valve 76, in its closed position, blocks flow into lower chamber 74 of cylinder 63. The high pressure vapor thus introduced into upper chamber 68 drives piston 65 downward, the downward motion of piston 65 causing refrigerant vapor present in chamber 74 from a previous half cycle to be exhausted through valve 78 into conduit 93.

By virtue of its direct coupling to piston 65, piston 66 also moves downward, driving refrigerant present in chamber 85 from a previous half cycle of operation through port 87, valve 89 and conduit 93 to condenser 58, and at the same time causing refrigerant to be drawn into upper chamber 79 of cylinder 64 from evaporator 57 via conduit 99, valve 83 and inlet port 81.

At the completion of the downward stroke of pistons 65 and 66, the first half cycle of operation of compressor 56 terminates, limit switches reverse the states of valves 72, 73, 76 and 78, and the second half cycle of operation is initiated.

Valves 72 and 78 are now closed and valves 73 and 76 are open. High pressure refrigerant vapor from boiler 59 is now introduced via conduit 111, valve 76 and port 75 into the lower chamber 74 of cylinder 63. The vapor in chamber 74 drives piston 65 and piston 66 upward. Vapor previously introduced into chamber 68 of cylinder 63 is exhausted through port 71 and valve 73 into conduit 93, and vapor introduced into chamber 79 of cylinder 64 is exhausted through port 82 and valve 84 into conduit 93. At the same time, vapor from evaporator 57 is drawn via conduit 99, valve 88 and inlet port 86 into chamber 85 of cylinder 64. At the end of the upward stroke, limit switches again reverse the state of valves 72, 73, 76 and 78, terminating the second half cycle in preparation for another succeeding first half cycle as described earlier.

It has thus been shown that during alternate half cycle, vapor from boiler 59 enters the upper and lower chambers of cylinder 63 driving pistons 65 and 66 upwardly and downwardly in a reciprocating action, whereby vapor from boiler 59 under pressure flows through power cylinder 63 to condenser 58 while vapor from evaporator 57 is pumped through work cylinder 64 to condenser 58. The pumping action of compressor 56 causes refrigerant vapor to be circulated about the two loops, including the heat pump loop and the power loop.

In the heat pump loop, condensed vapor from condenser 58 flows through conduit 94, through expansion valve 96, through evaporator 57, conduit 99, cylinder 64 and conduit 93 back to condenser 58. Evaporation of the refrigerant in evaporator 57 causes heat to be absorbed from the surrounding environment to perform the refrigeration action. The absorbed heat is discharged at the condenser. The smaller diameter of piston 66 (relative to the diameter of piston 65) provides the pressure rise required to overcome the pressure drop occurring across expansion valve 96.

In the power loop, vapor from boiler 59 passes through conduit 111 through cylinder 63 and conduit 93 to condenser 58. Vapor condensed into liquid from condenser 58 must be returned to boiler 59 through receivers 61 and 62 against the back pressure present in boiler 59. This is accomplished through the action of receivers 61 and 62 in cooperation with valves 102, 103 and 106.

During the first half cycle, switches 102, 103 and 106 are in the states shown in FIG. 2, i.e. switch 102 is closed and switches 103 and 106 are open. Condensed refrigerant flows from condenser 58 into receiver 61, aided by gravity, with back pressure from boiler 59 blocked by closed switch 102. Also, during the first half cycle, refrigerant previously supplied to receiver 62 flows through open valve 106 and conduit 107 into boiler 59 with pressure equalization provided by a return path comprising conduit 110 and open valve 103. As liquid refrigerant flows downward through conduit 107, aided by gravity, it is replaced by vapor from boiler 59 flowing upward through conduit 110. At the end of the first half cycle, valves 103 and 106 close and valve 102 opens, these three valves remaining in these states throughout the second half cycle during which time valves 103 and 106 block the back pressure of boiler 59 and valve 102 passes condensed refrigerant into receiver 62 from receiver 61.

At the end of the second half cycle, valves 102, 103 and 106 again change state for a repeated performance of the first half cycle.

A comparison of the heat pump 55 of FIG. 2 with prior art heat pump 10 of FIG. 1 reveals that a significant reduction in complexity and total hardware content is achieved in the heat pump of the present invention. The compressor of the present invention employs only two cylinders and two pistons as compared with four cylinders and four pistons in the prior art heat pump. In addition, the heat pump of the present invention employs only one refrigerant as compared with two refrigerants and an additional troublesome liquid in the case of the prior art. It is also to be noted that two condensers are required in the prior art, while the present invention employs only one condenser.

Figure 3:
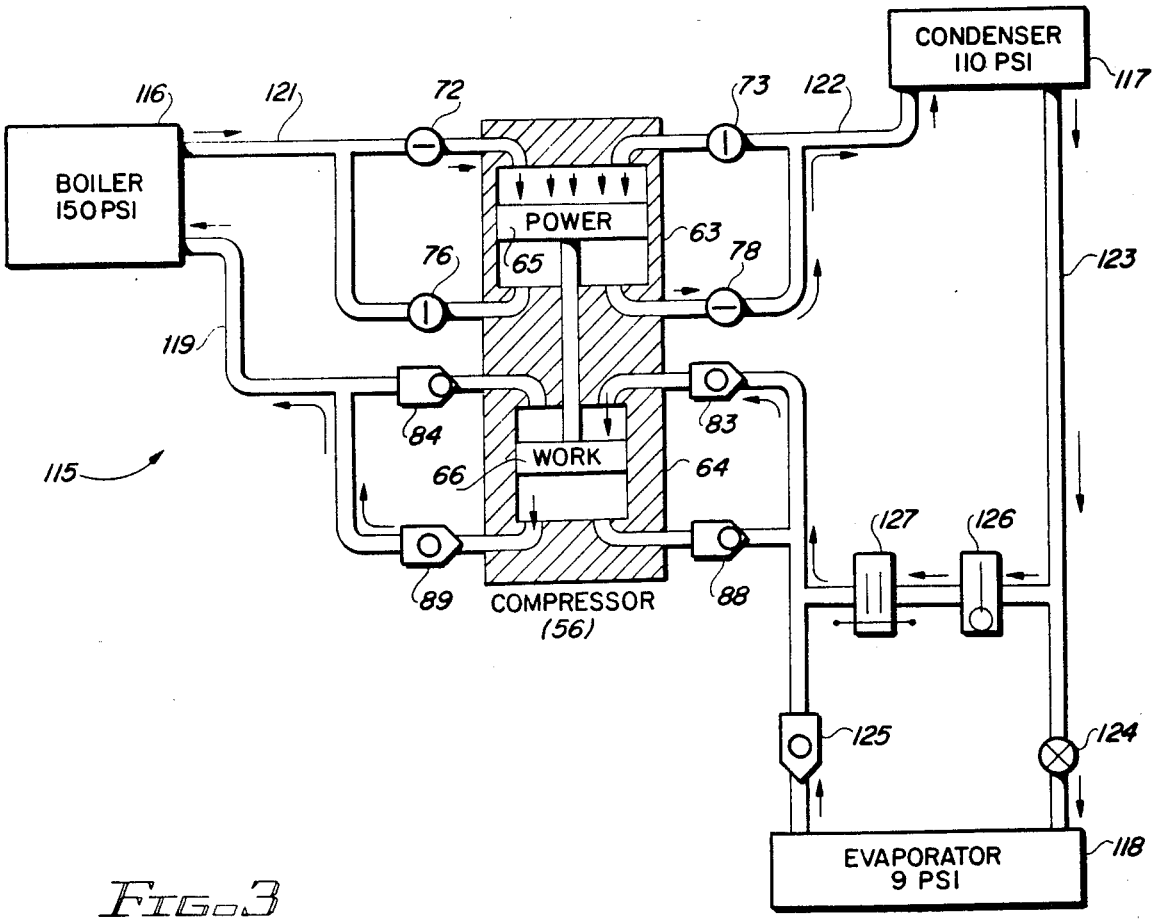
FIG. 3 is a functional diagram illustrating the construction and operation of a second embodiment of the heat actuated heat pump of the present invention.

In a second embodiment of the invention, as shown in FIG. 3, the heat actuated heat pump 115 comprises a boiler 116, a condenser 117, an evaporator 118 and the same compressor 56 as is employed in heat pump 55 of FIG. 2. In this arrangement, refrigerant pumped through cylinder 64 is delivered through valves 84 and 89, and a refrigerant conduit 119 to boiler 116. From boiler 116, high pressure vapor passes through a refrigerant conduit 121, through power cylinder 63 and through a refrigerant conduit 122 to condenser 117. From condenser 117, condensed refrigerant flows via two parallel paths to the intake valves 83 and 88 of cylinder 64.

The first of the two parallel paths is the cooling branch comprising a conduit 123, an expansion valve 124, evaporator 118 and a one-way valve 125. The second path comprises the conduit 123, a flow switch 126 and a solenoid controlled valve 127.

During each stroke of piston 66 in work cylinder 64, a vacuum is drawn in one of the chambers of cylinder 64 so that refrigerant vapor is drawn from evaporator 118 through valve 125 and through one or the other of valves 83 and 88 into cylinder 64. Near the end of each stroke, a sensor actuated by piston 66 opens valve 127 permitting liquid refrigerant to flow from conduit 123 through flow switch 126 and through one or the other of valves 83 and 88 into cylinder 64. At the end of the stroke, or when flow through switch 126 terminates, switch 126 senses the termination of flow and causes valve 127 to close. This series of events is repeated during each cycle of operation of compressor 56.

As in the case of the first embodiment, the heat actuated heat pump 115 represents a significant simplification as compared with the prior art heat pump 10 of FIG. 1. Pump 115 again comprises only two cylinders, two pistons, one boiler, one condenser, one evaporator and a single refrigerant.

Operating pressures shown for heat pumps 55 and 115 in FIGS. 2 and 3 are typical of the first implementations for the two embodiments of the inventinn, but are not to be construed as limiting the scope of the invention.

Figure 4:
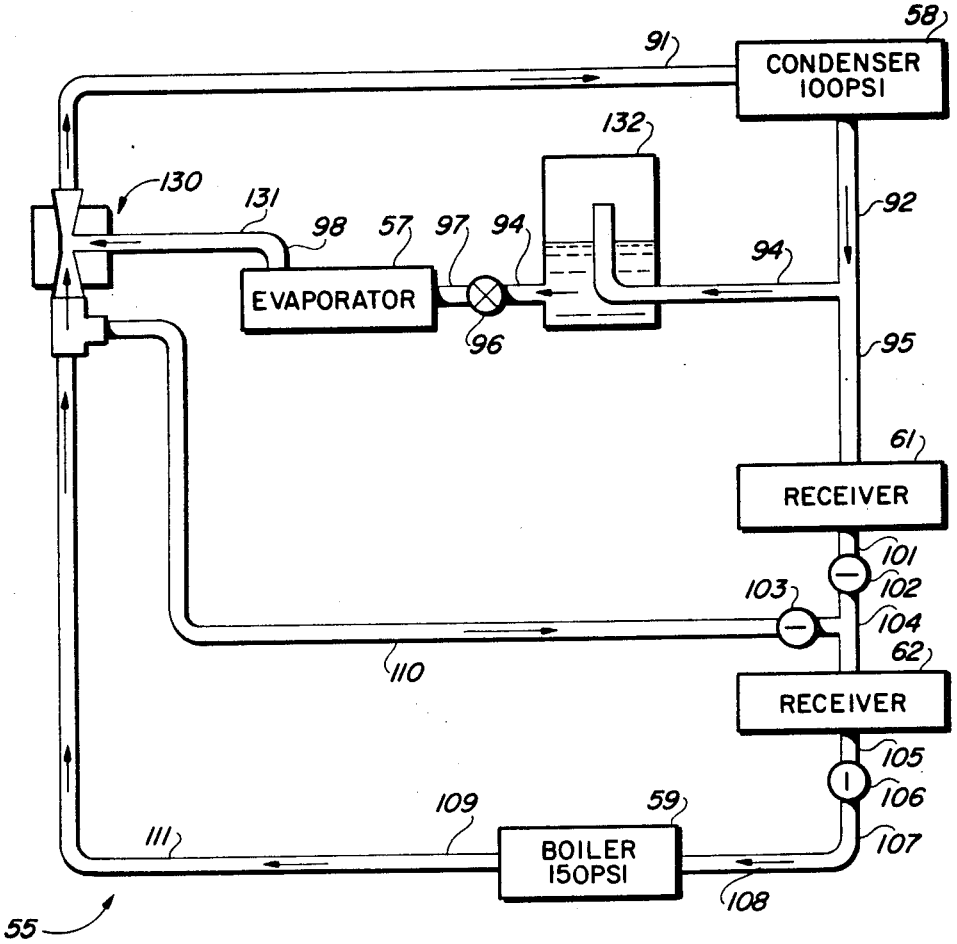
FIG. 4 is a functional diagram illustrating the construction and operation of a third embodiment of the invention embodying an aspirator or venturi in place of the compressor shown in FIGS. 2 and 3.

FIG. 4 illustrates a further modification of the invention as shown in FIG. 2, wherein like parts are given the same reference characters as used in FIG. 2.

Since compressor 56 is essentially a pump motor or aspirator driven by pressure from boiler 59, it can be replaced and is replaced in FIG. 4 by a venturi 130. Refrigerant in vapor form flows from boiler 59 where the pressure is high, through conduit 111, venturi 130 and conduit 91 to condenser 58. Some of the vapor flows through conduit 110 to valve 103 as shown in FIG. 2. Vapor is free to flow through conduit 110 and receiver 62, valve 106, conduit 107 to boiler 59 as long as valves 103 and 106 are open. In this instance, valve 102 is closed, thereby preventing vapor flow from conduit 110 through receiver 61 and into condenser 58. This vapor flow through conduits 110 and 111, valve 103 to receiver 62 causes a pressure balance between conduits 110 and 111.

Vapor flow through conduit 111 and venturi 130 creates a vacuum in venturi 130 which draws more vapor from evaporator 57 through conduit 131 into the venturi and through conduit 91 to condenser 58 where it is liquified.

Liquid refrigerant in condenser 58 overflows through conduits 92 and 94 into a liquid trap 132, from which it flows through conduit 94, expansion valve 96 and into evaporator 57 as a liquid where it is turned into a vapor form. It should be noted that evaporator 57 may be an air-conditioning unit.

As heretofore explained in the description of FIG. 2, liquid refrigerant is also gravity fed from condenser 58 into receiver 61. When valve 102 is opened, and valves 103 and 106 simultaneously closed, liquid refrigerant in receiver 61 flows into receiver 62 and condenses the vapor in receiver 62.

When the valves are again cyclically moved, valve 102 is closed and valves 103 and 106 are again opened, allowing higher pressure vapor from boiler 59 to enter conduits 111 and 110. As pressure balances in these conduits, gravity will move the liquid refrigerant from receiver 62 through conduits 107 and 108 into boiler 59.

Thus, a heat pump is disclosed, having no moving mechanical parts.

Figure 5:
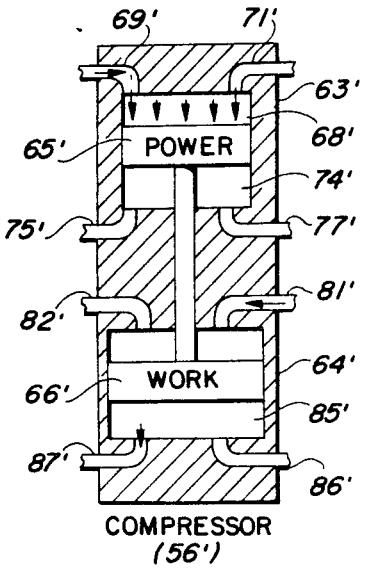
FIGS. 5 and 6 illustrate modifications of the compressor piston structure shown in FIG. 2.
Figure 6:
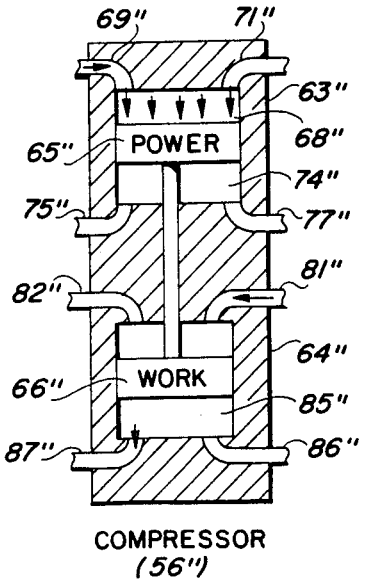

FIGS. 5 and 6 illustrate a further modification of the condenser 56 shown in FIG. 2 wherein similar parts are identified with prime and double prime reference characters.

FIG. 5 illustrates that power piston 65' of cylinder 63' may be smaller than work piston 66' of cylinder 64', and FIG. 6 illustrates that power piston 65'' of cylinder 63'' may be of the same diameter as work piston 66'' of cylinder 64'' and still fall within the scope of this invention. The piston sizes compensate for various evaporator conditions.

An improved heat actuated heat pump is thus provided in accordance with the stated objects of the invention, and although but a few embodiments of the invention have been illustrated and described, it will be apparent to those skilled in the art that various changes and modifications may be made therein without departing from the spirit of the invention or from the scope of the appended claims.

What is claimed is:

1. A compressor for a heat actuated heat pump comprising:

first and second cylinders, first and second pistons coupled together by a common shaft and operating, respectively, in said first and second cylinders, the first piston defining within said first cylinder a first chamber located on one side of said first piston and a second chamber located on the other side of said first piston, the second piston defining within said second cylinder a third chamber located on one side of said second piston and a fourth chamber located on the other side of said second piston, each of the chambers having an inlet port and an outlet port and valve means associated with each port for controlling the flow of a refrigerant therethrough, and control means for said valve means for supplying refrigerant to said inlet port of said first chamber and substantially simultaneously exhausting refrigerant from said outlet port of said second chamber during a first half cycle of operation of the compressor and for supplying refrigerant to said inlet port of said third chamber and substantialy simultaneously exhausting refrigerant from said outlet port of said fourth chamber during a second half cycle of operation of the compressor, said first piston being actuated in one direction by the refrigerant admitted to said first chamber during said first half cycle of operation and actuated in another direction by the refrigerant admitted to said second chamber during said second half cycle of operation, said valve means associated with the inlet and outlet ports of the third and fourth chambers during said first half cycle of operation causing refrigerant to be drawn into said third chamber and exhausted from said fourth chamber, and during said second half cycle of operation, causing refrigerant to be drawn into said fourth chamber and exhausted from said third chamber, whereby said first cylinder and its piston operate as a power means for the compressor while said second cylinder and its piston operate as a pumping means driven by said power means.

2. The compressor set forth in claim 1 wherein:

the diameter of said first piston is greater than the diameter of said second piston.

3. The compressor set forth in claim 1 wherein:

the diameter of said first piston is less than the diameter of said second piston.

4. The compressor set forth in claim 1 wherein:

the diameters of said first and second pistons are substantially equal.

5. The compressor set forth in claim 2 wherein:
said first and second cylinders comprise one geometrical configuration.

6. The compressor set forth in claim 1 wherein:
said valve means for said inlet port and said outlet port of said third chamber and said fourth chamber comprises one-way valves,
said one-way valve for the inlet ports of said third chamber and said fourth chamber pass refrigerant into said second cylinder and block the flow of refrigerant out of said second cylinder, and
said one-way valve for the outlet ports of said third chamber and said fourth chamber pass refrigerant out of said second cylinder and block the flow of refrigerant into said second cylinder.

7. The compressor set forth in claim 1 in further combination with:
a refrigerant,
a boiler,
a condenser,
an evaporator,
said first cylinder being connected in a series refrigerant flow connection with said condenser and said boiler to form a power loop,
said second cylinder being connected in a series refrigerant flow connection with said condenser and said evaporator to form a work loop,
said first piston being driven reciprocally by the refrigerant flow in the form of high pressure vapor from said boiler,
said second piston being driven by said first piston producing a pumping action for the refrigerant flow about said work loop, and
the refrigerant circulating about the work loop absorbing heat in said evaporator to provide a cooling function and releasing heat in said condenser for dissipation to the surrounding environment.

8. The compressor set forth in claim 7 wherein:
said boiler, said condenser and said evaporator are each provided with an inlet port and an outlet port,
a first coupling means for connecting said outlet port of said boiler to said inlet port of said first cylinder,
a second coupling means for connecting the outlet ports of said first and second cylinders to said inlet port of said condenser, and
a third coupling means for connecting the outlet port of said condenser to the inlet port of said boiler and to the inlet port of said evaporator, and
a fourth coupling means for connecting the outlet port of said evaporator to said inlet port of said second cylinder.

9. The compressor set forth in claim 8 wherein:
said third coupling means comprises receiver means for returning condensed refrigerant vapor from said condenser to said boiler against back pressure of the refrigerant in said boiler.

10. The compressor set forth in claim 9 wherein:
said receiver means comprises conduit means for connecting said outlet port of said boiler to said receiver,
whereby condensed vapor flow into said boiler from said condenser replaces vapor refrigerant flow from said boiler to said receiver means.

11. The compressor set forth in claim 8 wherein:
the diameter of said first piston is greater than the diameter of said second piston, and
said inlet port of said evaporator comprises an expansion valve,
whereby the relative size of said second piston to said first piston compensates for the pressure drop of the refrigerant across said expansion valve.

12. The compressor set forth in claim 9 wherein:
said receiver means collects condensed refrigerant from said condenser during the first one half cycle of operation of the compressor and transmits condensed refrigerant to said boiler during the second half cycle of operation of said compressor.

13. The compressor set forth in claim 7 in further combination with:
said work loop comprising a second valving means operable upon predetermined movement of said second piston for bypassing the flow of refrigerant from said condenser around said evaporator to said second cylinder.

14. A refrigerating system comprising in combination:
a boiler containing a refrigerant,
an aspirator,
an evaporator,
means for supplying a vapor of said refrigerant from said boiler at high velocity to said aspirator for operating said aspirator to draw off vapor from said evaporator,
a condenser, and
receiver means,
said condenser being positioned to receive fluid delivered thereto by said aspirator,
gravity means for supplying liquid refrigerant to said evaporator to replace refrigerant evaporated therefrom and to said receiver means,
said receiver means comprising valve means and conduit means for conducting fluid received from said condenser to said boiler against the back pressure of the refrigerant in said boiler while simultaneously receiving vapor of said refrigerant from said boiler,
said valve means being operated cyclically in a two cycle manner whereby during a first cycle said valve means admits fluid into said conduit means from said condenser and during said second cycle bars fluid flow from said condenser means into said conduit means while admitting under gravity the flow of fluid from said conduit means into said boiler.

* * * * *